US011192046B2

(12) United States Patent
Pogue et al.

(10) Patent No.: US 11,192,046 B2
(45) Date of Patent: Dec. 7, 2021

(54) BUBBLE, FOG, HAZE AND FOG-FILLED BUBBLE MACHINE

(71) Applicants: Adam G Pogue, Jackson, TN (US); Christopher E Markgraf, West Palm Beach, FL (US)

(72) Inventors: Adam G Pogue, Jackson, TN (US); Christopher E Markgraf, West Palm Beach, FL (US)

( * ) Notice: Subject to any disclaimer, the term of this patent is extended or adjusted under 35 U.S.C. 154(b) by 0 days.

(21) Appl. No.: 16/687,508

(22) Filed: Nov. 18, 2019

(65) Prior Publication Data

US 2020/0078699 A1 Mar. 12, 2020

Related U.S. Application Data

(63) Continuation of application No. 15/530,502, filed on Jan. 23, 2017, now Pat. No. 10,500,520.

(51) Int. Cl.

| | |
|---|---|
| ***A63H 33/28*** | (2006.01) |
| ***A63J 5/02*** | (2006.01) |
| *G09F 19/12* | (2006.01) |
| *B05B 7/00* | (2006.01) |

(52) U.S. Cl.

CPC ..... *A63J 5/025* (2013.01); *A63H 33/28* (2013.01); *B05B 7/0075* (2013.01); *B05B 7/0081* (2013.01)

(58) Field of Classification Search

CPC ..... A63H 33/00; A63H 33/28; F24C 7/004; G09F 19/00; G09F 19/12

USPC ..... 446/15–21; 472/59, 65, 66; 40/406–408, 40/428

See application file for complete search history.

(56) References Cited

U.S. PATENT DOCUMENTS

| | | | | |
|---|---|---|---|---|
| 7,086,920 | B2 * | 8/2006 | Fusco | A63H 33/28 446/15 |
| 2002/0094744 | A1 * | 7/2002 | Cheng | A63H 17/00 446/15 |
| 2004/0259458 | A1 * | 12/2004 | Fusco | A63H 33/28 446/15 |
| 2005/0148276 | A1 * | 7/2005 | LaFata | A63H 31/08 446/18 |
| 2006/0116048 | A1 * | 6/2006 | Choi | A63H 33/28 446/15 |
| 2012/0220184 | A1 * | 8/2012 | Orem | A63H 33/28 446/16 |

* cited by examiner

*Primary Examiner* — Kien T Nguyen
(74) *Attorney, Agent, or Firm* — Gordon E. Gray, III; Gray Law Firm

(57) ABSTRACT

The present invention is a bubble, fog, haze, and fog-filled bubble machine. In particular, the present invention is directed to a single unit machine that can produce bubbles, fog, fog-filled bubbles or haze. The machine preferably comprises a housing having a front portal, a bubble section, a fog section, and a control interface, where the housing is connected to a power source. The bubble section is located behind the front portal and has a bubble wand motor attached to a rotatable wheel with a number of bubble wands. The bubble wands pass through a bubble fluid reservoir. The fog section is located behind the bubble section and comprises a fog outlet in front of a fan, where the fog outlet is connected to a fog heater core and a fog pump is in turn connected to a fog fluid reservoir. The control interface controls the selection of effects.

1 Claim, 6 Drawing Sheets

BUBBLE, FOG, HAZE AND FOG-FILLED BUBBLE MACHINE

This is a continuation application of U.S. Ser. No. 15/530,502, filed Jan. 23, 2017. Said patent application is incorporated herein by reference in its entirety.

TECHNICAL FIELD

The present invention is a bubble, fog, haze, and fog-filled bubble machine. In particular, the present invention is directed to a single unit machine that can produce bubbles, fog, fog-filled bubbles or haze.

BACKGROUND ART

Currently, in the theatrical and other performance or amusement fields, multiple machines are required to create bubbles, fog, fog-filled bubbles or haze. Moreover, machines that produce bubbles filled with smoke or fog are generally limited to small hand-held units that are limited to the production of single or one-at-a-time bubbles such as U.S. Pat. No. 7,086,920. Accordingly, a single unit machine is needed that can produce bubbles, fog, fog-filled bubbles, or haze (or a combination of these effects) in increased quantities for, e.g. various theatrical or performance venues and situations.

SUMMARY OF THE INVENTION

The present invention is a bubble, fog, haze, and fog-filled bubble machine. In particular, the present invention is directed to a single unit machine that can produce bubbles, fog, fog-filled bubbles or haze. The machine preferably comprises a housing having a front portal, a bubble section, a fog section, and a control interface, where the housing is connected to a power source. The bubble section is located behind the front portal and has a bubble wand motor attached to a rotatable wheel with a number of bubble wands. The bubble wands pass through a bubble fluid reservoir. The fog section is located behind the bubble section and comprises a fog outlet in front of a fan, where the fog outlet is connected to a fog heater core and a fog pump is in turn connected to a fog fluid reservoir. The control interface controls the selection of effects.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a bubble, fog, haze and fog-filled bubble machine.

Figure 1:
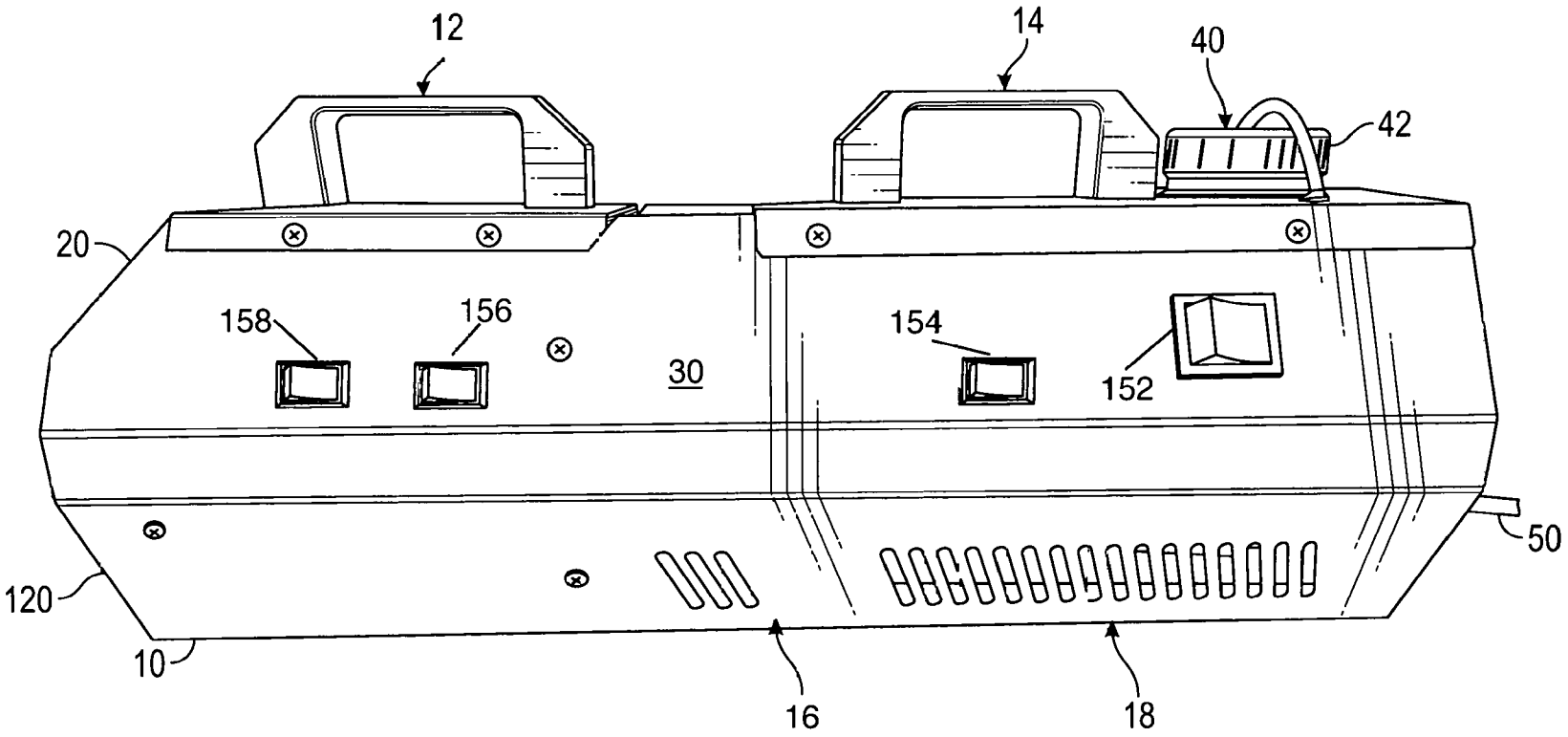
FIG. 1 is a side view of a preferred embodiment of the invention.

Referring now to FIG. 1, a side view of a preferred embodiment of the invention is shown. The invention preferably comprises a housing 10 having a front portal 20, a control interface side panel 30 and a fog fluid reservoir 40. The housing 10 is preferably made of metal. The housing 10 preferably has a front handle 12 and a rear handle 14. The housing 10 preferably has an air vent 16 and a heat vent 18 in the lower or bottom portion of the housing 10. The housing 10 is preferably connected to an external power supply 50. Preferably, the external power supply 50 is 110 v.

Figure 2:
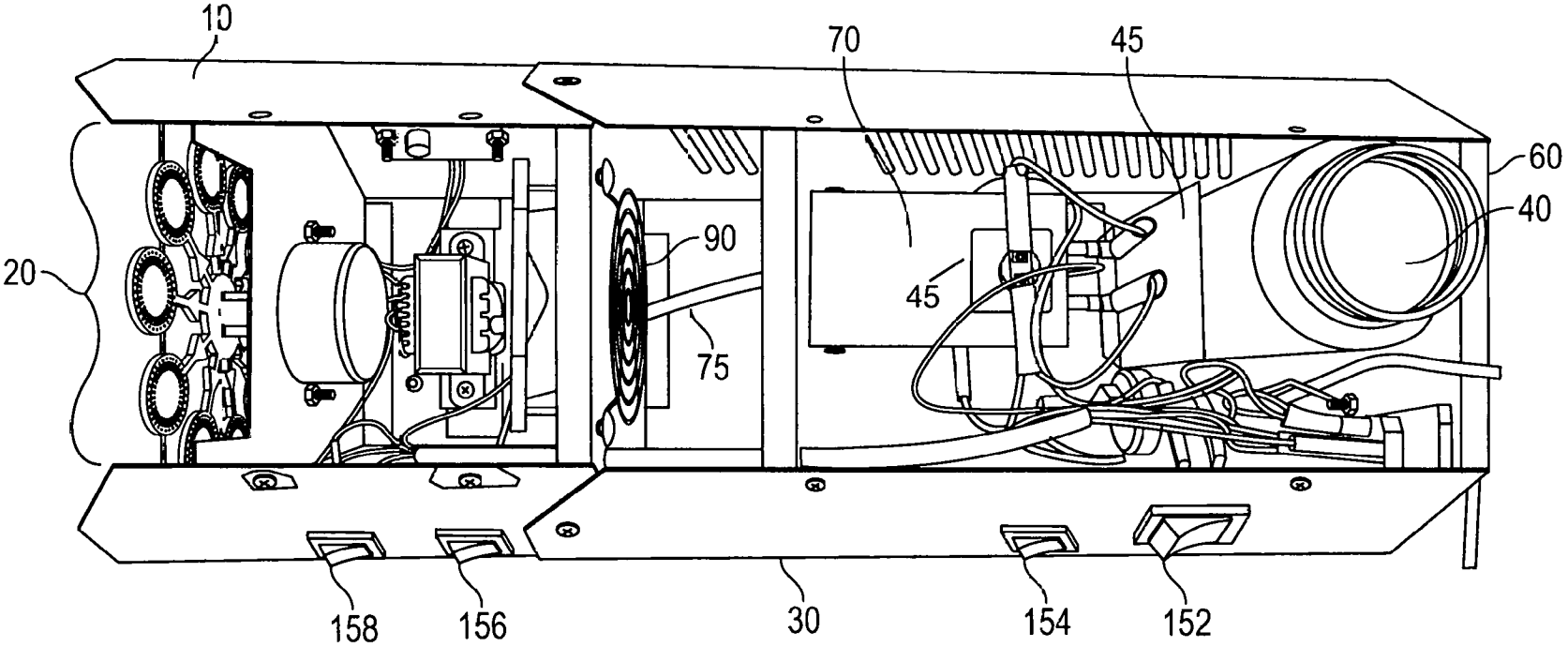
FIG. 2 is a top partial cut-away view of a preferred embodiment of the invention.
Figure 5:
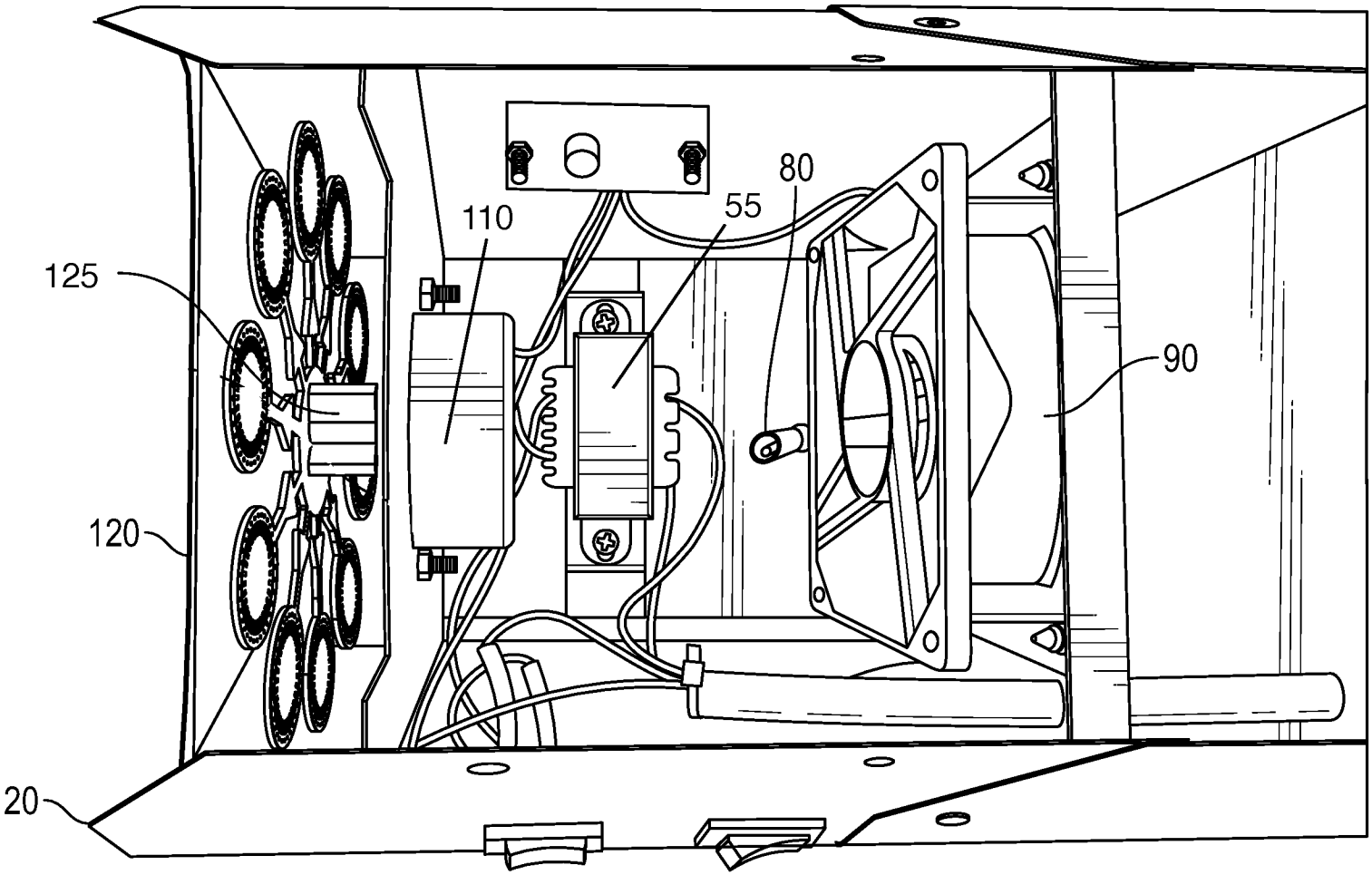
FIG. 5 is a partial top view of a preferred embodiment of the invention; and, FIG. 6 is a front perspective view of a preferred embodiment of the invention.

Referring now to FIG. 2, a top cut away view of a preferred embodiment of the invention is shown. The housing 10 preferably has a front portal 20 and a rear plate 60. The fog fluid reservoir 40 is preferably placed in the rear of the housing 10 where the reservoir opening 42 (shown in FIG. 1) extends above the top of the housing 10. The fog fluid reservoir 40 is connected to a fog fluid heater core 70 by a fog fluid pump 45. Fog fluid, e.g. various glycols or glycerin and de-ionized water, is pumped by the pump 45 into the heater core 70 where it is flash vaporized into high pressure fog that is then expelled via a heater core nozzle 75 to a fog outlet 80 (shown in FIG. 5.) Preferably, the heater core 70 is between 400 watts and 1000 watts. However, the heater core 70 can be varied in size depending on the application size. Referring now to FIG. 5, the fog outlet 80 is preferably positioned in front of a fan 90. The fan 90 preferably provides constant forced air. The applicable "cubic feet per minute" rate ("CFM") of the fan again depends on the application size and/or heater core size. However, a rating of between 10 and 300 CFM is preferred.

Referring to FIG. 5, behind the front portal 20, a bubble fluid reservoir 120 is preferably located. Preferably, a rotatable wheel 125 having a plurality of bubble wands 127 is connected to a bubble wand motor 110. The bubble wand motor 110 can rotate the wheel of bubble wands 125 through bubble fluid, e.g. liquid soap and water, in the bubble fluid reservoir 120 to coat the plurality of bubble wands 127. The wheel 125 preferably rotates at roughly 24 revolutions per minute. However, this rate can vary due to factors such as desired bubble production volume and bubble fluid consistency. Once coated, air from the fan 90 can blow bubbles from the wands 127 so the bubbles can exit from the front portal 20. Also shown in FIG. 5, the external power supply 50 is connected to the various powered items in the housing. For example, the bubble wand motor 110 is connected to the power supply 50 by a power distribution node 55.

Figure 4:
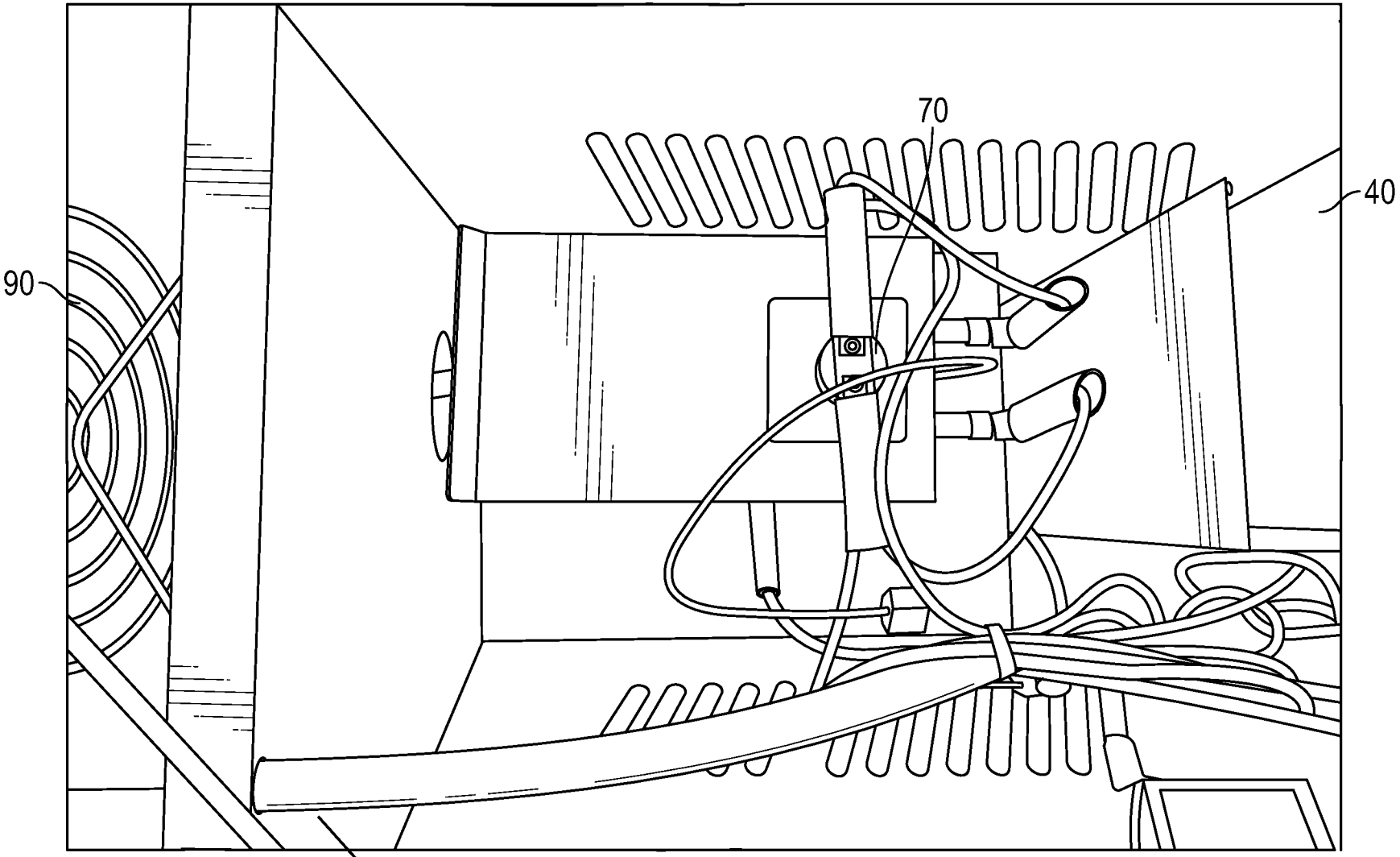
FIG. 4 is a partial top view of a preferred embodiment of the invention.

During preferred operation of the device, fog is generated from fog fluid that is flash vaporized and then expelled via the heater core nozzle 75 to a fog outlet 80, the fog is moved by the fan 90 into the bubbles created from the bubble wands 127 thus creating fog-filled bubbles (also referred to as bubble-fog). Thus, fog is generated in the fog section of the device shown in FIG. 4 and bubbles are generated in the bubble section of the device shown in FIG. 5.

A preferred embodiment of a control interface side panel 30 with control interface 150 is shown in FIG. 1. The control interface 150 preferably comprises a main power switch 152 for turning power on or off to the entire unit. The main power switch 152 also turns the heater core 70 on or off. The control interface 150 also preferably comprises a fog machine pump switch 154 for turning the fog pump 45 on or off to control fog fluid flow from the fog fluid reservoir 40 to the heater core 70. If the fog fluid pump 45 is "on," fog fluid is turned to fog in the heater core 70. The fan switch 156 preferably controls whether the fan 90 is "on" or "off" and providing constant forced air. Preferably, the control interface 150 preferably comprises a bubble wand switch 158. The bubble wand switch 158 preferably is a 3-way switch with settings of "on," "off," and "Bubble Wand Activated to turn when Fog Machine Pump Engaged." Accordingly, depending on the settings of the control interface 150, the present invention can preferably create four separate effects from a single unit machine, namely bubbles, fog-filled bubbles, fog or haze (or a combination of those effects). For example, if the bubble wand switch 158 is "on" and the fan switch 156 is "on" and the main power switch is "on" but the fog machine pump switch is "off," only bubbles are created and expelled through the front portal 20. If the main power switch 152 is "on," the bubble wand switch 158 is "Bubble Wand Activated . . . " and the fan switch 156 and the fog machine pump switch 154 are "on," the unit expels fog-filled bubbles out of the front portal 20. If the main power switch 152 is "on," the bubble wand switch 158 is "off" and the fan switch 156 and the fog machine pump switch 154 are "on," the unit expels haze out of the front portal 20. If the main power switch 152 is "on," the bubble wand switch 158 is "off" and the fan switch 156 is "off" and the fog machine pump switch 154 is "on," the unit expels fog out of the front portal 20. Alternatively, the control interface 150 can be a digital unit that controls the switches 152, 154, 156 and 158 while providing the user with an effect menu, e.g. "Bubbles", "Fog," "Haze" or "Bubble-Fog", for selection by the user.

Figure 3:
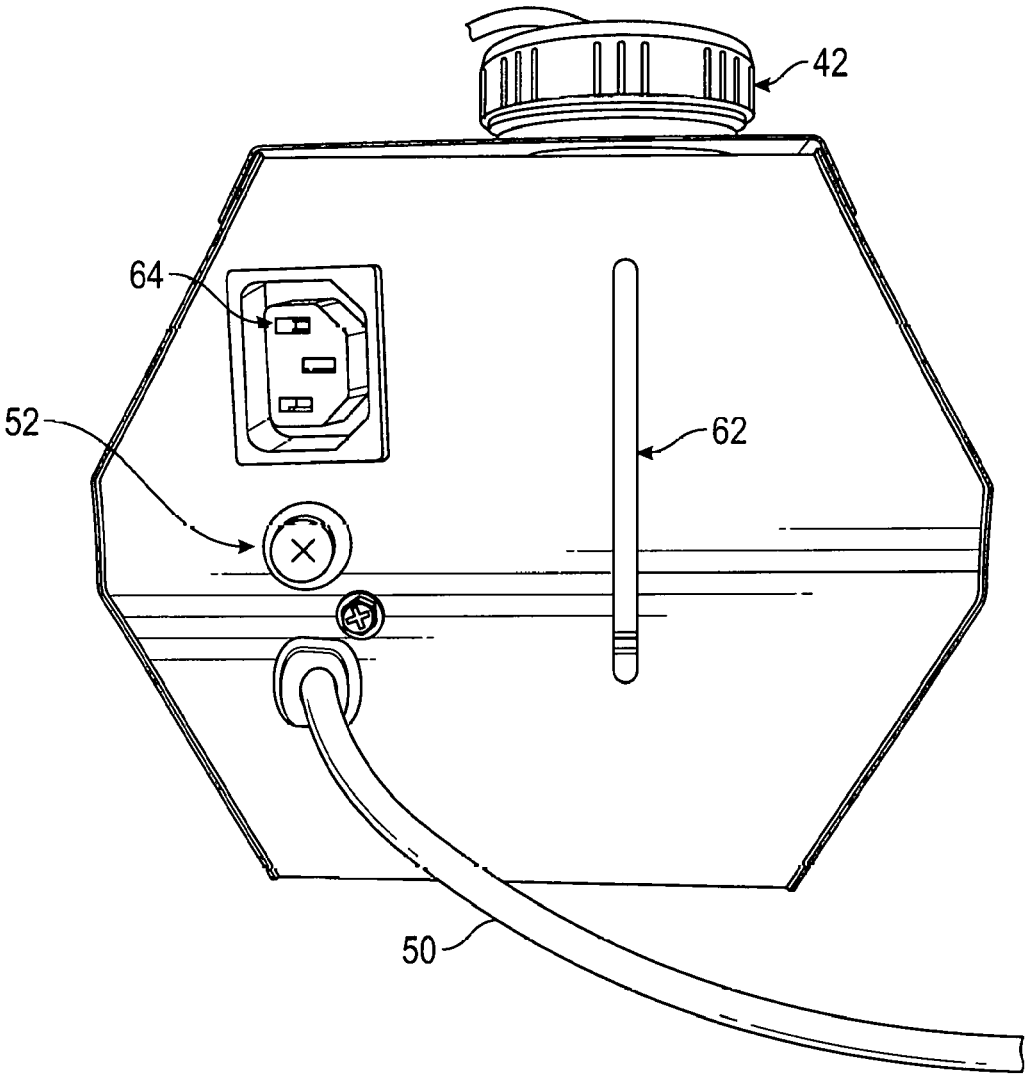
FIG. 3 is a rear view of a preferred embodiment of the invention.

Referring now to FIG. 3, a preferred embodiment of the rear panel 60 is shown. Preferably, the rear panel 60 has a slot 62 for use as a fog fluid level indicator showing the fog fluid level in the reservoir 40. Also, the external power supply 50 preferably is connected to the unit via a fuse 52. The rear panel 60 also preferably has a remote control access port 64. The port 64 is preferably used for wired or wireless remotes or timer remotes to control the control interface 150 and operate the various effects (bubbles, fog, haze or fog-filled bubbles) from the unit.

Figure 6:
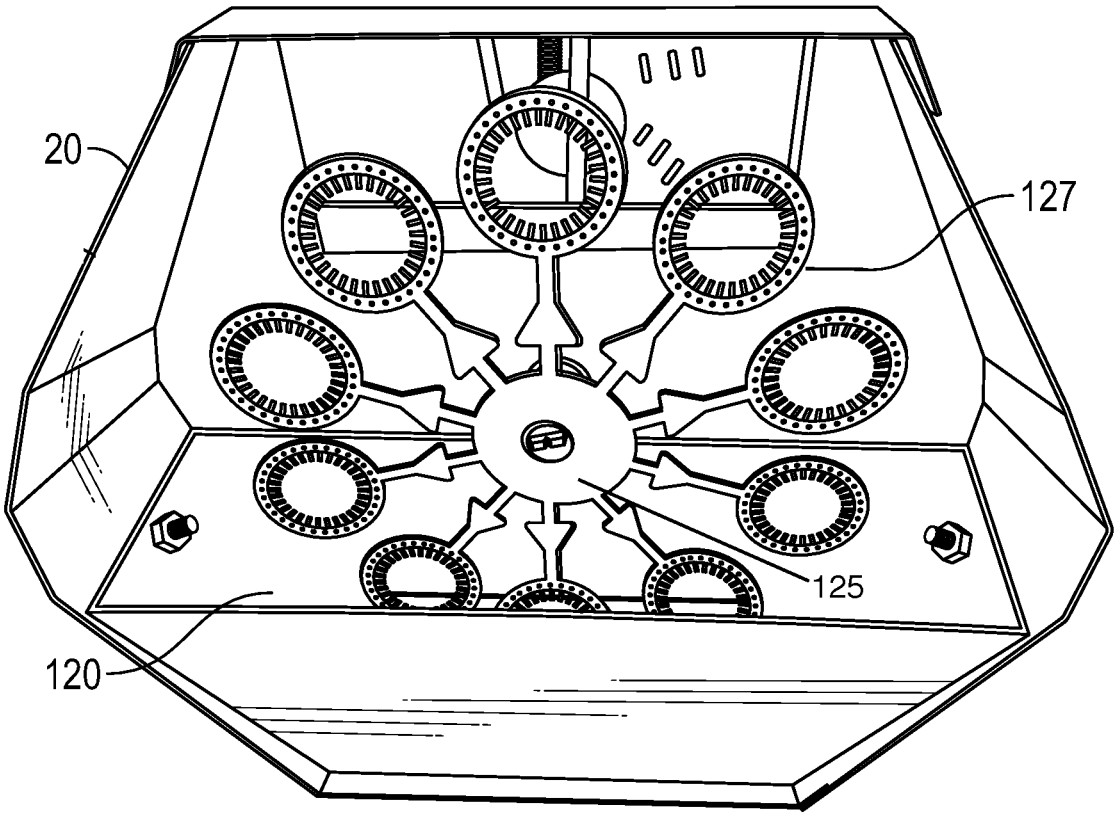

Referring now to FIG. 6, a perspective front view of a preferred embodiment of the invention is shown. The front portal 20 is shown above the bubble fluid reservoir 120. A preferred embodiment of the wheel 125 of bubble wands 127 is shown, rotatable through the reservoir 120.

Thus, an improved bubble, fog, haze and fog-filled bubble machine is described above that is a single unit machine that can produce bubbles, fog, fog-filled bubbles, or haze (or a combination of these effects) in increased quantities for, e.g. various theatrical or performance venues and situations. In each of the above embodiments, the different positions and structures of the present invention are described separately in each of the embodiments. However, it is the full intention of the inventors of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. Therefore, it is to be understood that, within the scope of the appended claims, the invention may be practiced other than as specifically described herein.

Various modifications and alterations of the invention will become apparent to those skilled in the art without departing from the spirit and scope of the invention, which is defined by the accompanying claims. It should be noted that steps recited in any method claims below do not necessarily need to be performed in the order that they are recited. Those of ordinary skill in the art will recognize variations in performing the steps from the order in which they are recited. In addition, the lack of mention or discussion of a feature, step, or component provides the basis for claims where the absent feature or component is excluded by way of a proviso or similar claim language.

While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A bubble machine comprising:

a housing having a front portal, a bubble section, a haze section, and a control interface, where the housing is connected to a power source;

where the bubble section comprises a bubble wand motor attached to a rotatable wheel with a plurality of bubble wands where the plurality of bubble wands pass through a bubble fluid reservoir;

where the haze section comprises a haze outlet and a fan, where the haze outlet is connected to a haze heater core and a haze pump which is in turn connected to a fluid reservoir;

where the control interface controls the production of haze-filled bubbles and where the control interface further comprises a remote control access port.

* * * * *